US006581752B2

(12) United States Patent
Frei

(10) Patent No.: US 6,581,752 B2
(45) Date of Patent: Jun. 24, 2003

(54) METHOD AND DEVICE FOR SPLITTING-UP A STREAM OF PIECE GOODS

(75) Inventor: Hans Frei, Oetwil am See (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/859,153

(22) Filed: May 16, 2001

(65) Prior Publication Data

US 2001/0045342 A1 Nov. 29, 2001

(30) Foreign Application Priority Data

May 17, 2000 (CH) ..... 986/00

(51) Int. Cl.[7] ..... B65G 47/26
(52) U.S. Cl. ..... 198/440; 198/449
(58) Field of Search ..... 198/440, 449, 198/443, 470.1

(56) References Cited

U.S. PATENT DOCUMENTS 3,339,701 A * 9/1967 Weichhand ..... 198/449
3,635,322 A * 1/1972 Raudat et al. ..... 198/440

(List continued on next page.)

FOREIGN PATENT DOCUMENTS

EP 0 633 212 B1 3/1997
EP 0 908 406 A1 4/1999
EP 1 063 187 A1 12/2000

OTHER PUBLICATIONS

WO 98/03419, Publication Date: Jan. 29, 1998, Apparatus for Bringing Pressroom Products to Processing Stations.
WO 98/03420, Publication Date: Jan. 29, 1998, Conveyor.
WO 99/33731, Publication Date: Jul. 8, 1999, Conveyor System.
WO 99/33720, Publication Date: Jul. 8, 1999, Conveyor System.

*Primary Examiner*—James R. Bidwell
(74) *Attorney, Agent, or Firm*—Rankin, Hill, Porter & Clark LLP

(57) ABSTRACT

For splitting-up a supply stream (2) of piece goods into a plurality of conveying away streams, the supplied objects (3) are guided onto a plurality of conveying away paths (4.1, 4.2, 4.3) in a predetermined splitting-up sequence. The device includes a supply device for serially supplying objects (3) to a split-up point (1) and for positioning the objects (3) for being taken over by holding device (6.1, 6.2, 6.3) in the split-up point (1). The device also has a plurality of conveying away systems, each one of which defines one of the conveying away paths. Of the conveying away systems advantageously each one has a closed-loop rail track (5.1, 5.2, 5.3) and holding devices (6.1, 6.2, 6.3) movable along the rail track independently of one another and with variable distances between one another. The rail tracks (5.1, 5.2, 5.3) of the conveying away systems converge toward the split-up point (1), run through the split-up point (1) parallel to one another, and diverge after the split-up point (1). The conveying away systems also have buffers that retain the holding devices upstream of the split-up point (1) and devices for releasing the holding devices from the buffers (7.1, 7.2, 7.3) in a controlled manner. The conveying away systems also have devices for conveying the holding devices (6.1, 6.2, 6.3) through the split-up point (1) in a controlled manner and for activating the holding devices in the split-up point. A serial stream of holding devices through the split-up point (1) is produced by controlled release of holding devices (6.1, 6.2, 6.3) from the buffers (7.1, 7.2, 7.3) so that holding devices belonging to different conveying away systems are arranged in a sequence corresponding to the splitting-up sequence for the objects (3).

22 Claims, 7 Drawing Sheets

U.S. PATENT DOCUMENTS 3,809,214 A 5/1974 Reist
4,678,172 A * 7/1987 Faltin ..... 198/440 X
5,992,610 A 11/1999 Dufour et al.
6,062,372 A 5/2000 Cote et al.
6,401,903 B1 * 6/2002 Berni ..... 198/440 X

* cited by examiner

Fig.1
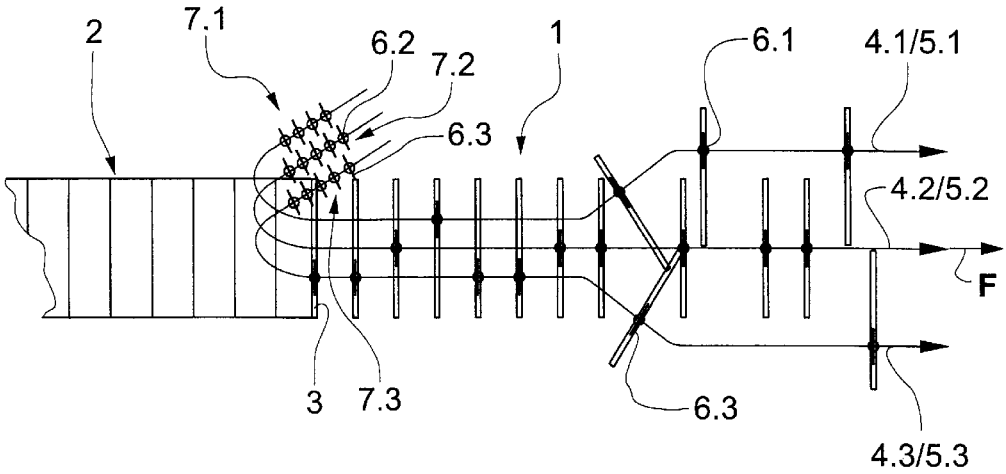
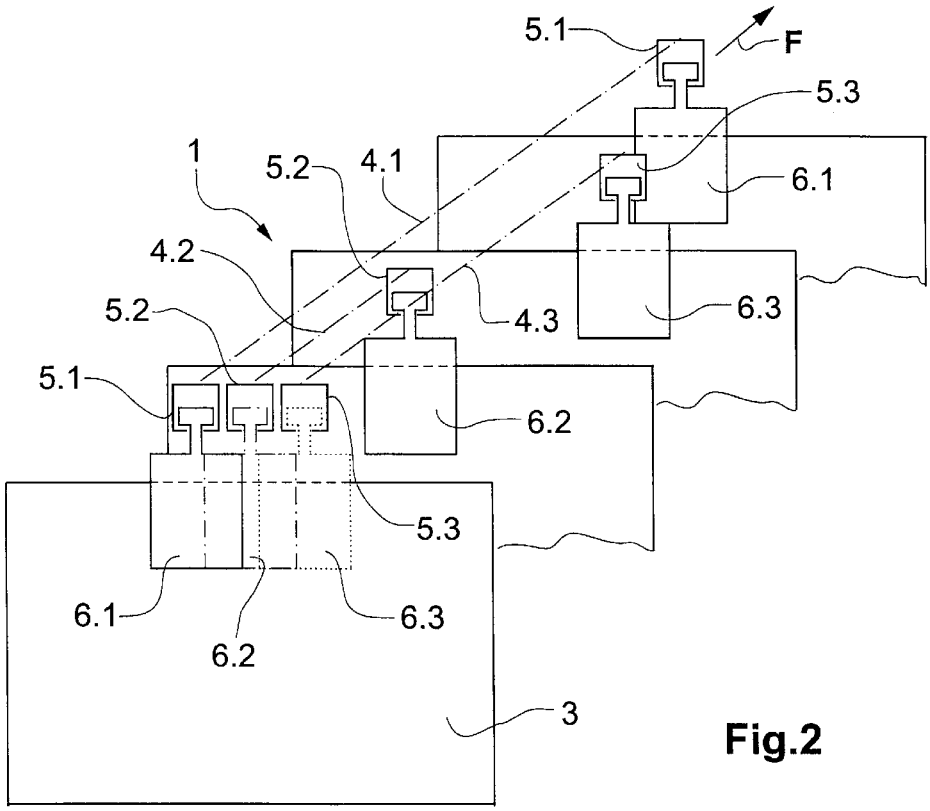
Fig.2

METHOD AND DEVICE FOR SPLITTING-UP A STREAM OF PIECE GOODS

BACKGROUND OF THE INVENTION

The present invention is in the field of piece goods conveying and generally concerns a method and device for splitting-up, according to a predetermined splitting-up sequence, a serial stream of piece goods being conveyed along a plurality of conveying away paths. More particularly, the method and device serve to split-up a stream of goods in which a large number of identical, or at least similar, objects (piece goods) are serially conveyed to form a plurality of different streams to be conveyed away. At the split-up point, the conveying path of the supply stream branches out in a plurality of conveying away paths and the objects are selectively guided onto one of the conveying away paths along which they are again serially conveyed onwards.

In the further processing of printed products, which is an example of an application for piece goods conveyance, conveyed streams can consist of printed products that are, for example, loosely lying on a conveyor surface (e.g., a conveyor belt). In such streams, the printed products usually overlap one another to define imbricated streams. Alternatively, such streams can consist of printed products that are held individually or in small groups by a gripper and conveyed behind each other in a hanging position. The grippers are installed on a conveying organ such as a conveyor chain, or else they are movable along a rail track more or less independently of one another. Such independent grippers are driven by corresponding drives, for example, by pushing one another along.

Shunt-like devices are usually employed for splitting-up imbricated streams of printed products. Devices of this kind are located at the split-up point and comprise a conveying support that is arranged between the feeder conveying support and the plurality of the conveying supports leading away. This conveying support swivels or is otherwise movable to selectively connect the conveying support of the feeder conveyor with one or another of the conveying supports leading away. Because the printed products in the imbricated stream overlap one another, it is necessary to provide, in addition to the swivelling conveying support, means for separating the imbricated stream, i.e. for locally cancelling the overlapping of the products for every changeover of the shunt. An example of an imbricated stream shunt is described, for example, in the publication EP-1063187.

For splitting-up a stream of printed products held individually or in small groups by supply system grippers, which are installed on a conveying organ, the printed products are selectively transferred to further conveyor systems, which, for example, also have grippers installed on conveying organs and designed for guiding the printed products away along the chosen path. Transfer points to a plurality of conveying away systems are usually arranged one behind the other along the supply track and, therefore, use up a lot of space.

In conveying systems, in which printed products are conveyed and held by grippers and in which the grippers are movable along a rail track independently of one another, points for splitting-up the conveyed stream are usually designed as rail junctions. Such points need to be equipped with control means for guiding the grippers from the supply rail to the desired rail leading away from the supply rail. In a conveying system comprising one or more splitting-up points of this type, provisions have to be made for the grippers, which are guided onto the various paths leading away, to be returned to a common point of departure. This means that return tracks have to be provided, which once again have to comprise shunts and joining points. Conveying systems of the named kind are described, for example, in the publications WO-98/03420 and WO-98/03419, a corresponding shunt in the publication WO-99/33720.

Also known are mixed forms of the above-described devices for splitting-up serial streams of piece goods.

SUMMARY OF THE INVENTION

An object of the present invention is to create a method and a device by means of which a serial stream of objects (piece goods) can be split-up into a plurality of further serial streams in which the objects are conveyed away. The splitting-up is to be controllable, for example, in accordance with a predetermined split-up sequence or by conditions further downstream or upstream and recorded by sensors. Alternatively, splitting-up is governed by a regular splitting cycle. At least the conveying away is to be a gripped conveyance, in which the objects are conveyed away and held, either individually or in small groups, by a gripper. The device according to the invention is to be simple, as universally utilizable as possible and, in particular, it shall be very space-saving.

In accordance with the method of the present invention, objects are serially conveyed toward a split-up point and, at the split-up point, they are positioned for being individually taken over by a holding means. For every object or small group of objects being positioned in the split-up point a holding means is supplied to the split-up point. This holding means belongs to the one conveying away system of the plurality of such systems, which defines the one leading away track on which the specific object or the specific group of objects is to be conveyed away. Therefore, holding means belonging to different conveying away systems are conveyed through the split-up point one after the other. For being supplied to the split-up point, the holding means are selectively released from buffers, which buffers also belong to different conveying away systems. Each one of the holding means supplied to the split-up point grips one of the positioned objects (or groups of objects) in order to convey it away from the split-up point along the leading away track of the conveying away system to which the holding means belongs.

The objects can be supplied with a regular or irregular spacing between them. A supply stream with an essentially regular spacing can also have gaps. Depending on the supply of the objects, holding means are supplied from the buffer of one conveying away system at the time to the split-up point either one per conveying cycle or selectively one or none (gap), or else just when required.

The device according to the invention comprises means for serially conveying objects to a split-up point and, at the split-up point, means for positioning the objects or groups of objects for being taken over by a holding means. The device further comprises a plurality of conveying away systems, wherein each of the conveying away systems comprises a rail track (advantageously being closed in itself) and a plurality of holding means movable along the rail track in the direction of conveyance. The rail tracks of rails of all conveying away systems advantageously converge or run parallel toward the split-up point, run parallel to one another and as close as possible to one another through the split-up point, and diverge after the split-up point.

As closely as possible upstream of the split-up point, each conveying away system comprises means for buffering holding means and means for a controlled release of holding means from the buffering means. Each conveying away system further comprises means for controlled conveyance of holding means through the split-up point and means for activating holding means in the split-up point for picking up an object. In order to be able to be buffered and to be recalled from the buffer in a controlled manner, the holding means of each conveying away system are movable independently of one another along the rail track of the conveying away system. Alternatively, the holding means are linked together with flexible means such that the spacing between adjacent holding means is variable.

In further accordance with the present invention, the device includes control means for coordinating the recall of the holding means from the buffer such that the serial stream of holding means conveyed through the split-up point comprises a sequence of holding means belonging to the various conveying away systems, which sequence corresponds to a required split-up sequence.

Because for every conveying away of an object only one holding means of one of the conveying away systems is released and transported through the split-up point, the holding means conveyed through the split-up point form a serial stream. In this stream the holding means can readily be conveyed on conveying paths, which are partially overlapping or identical. This means that even when the rail tracks of the conveying away systems run through the split-up point with minimum distances between each other there are no unwanted collisions during the transportation through the split-up point because of the serial release of the holding means from the various buffers. Neither are there undesirable simultaneous interactions of several holding means with a single object.

In the serial stream of holding means through the split-up point, the holding means have a spacing between one another, which is matched to the spacing between the supplied objects. This spacing can, therefore, be regular or irregular (also substantially regular, but with gaps).

Advantageously, the rail tracks of the conveying away systems pass through the split-up point as close to one another as possible. In this manner, during the taking-over of the objects, the positions of the holding means of different conveying away systems relative to the position of the objects to be taken over manifest as little difference from one another as possible. In such cases, where it is necessary for all objects to be picked up by the holding means in the same zone—independent of the path they are to be conveyed away on—, the following solution is provided: depending on which conveying away system is to take over an object, a rail track, a holding means, the object to be taken over, or the supply system or a part thereof is designed to be displaceable perpendicular to the general direction of conveyance in the area of the split-up point. It is also possible to design the holding means of the various conveying away systems correspondingly differently, such that their position relative to their rail track is different.

BRIEF DESCRIPTION OF THE DRAWINGS

These and further features of the present invention will be apparent with reference to the following description and drawings, wherein:

FIG. 1 shows the operating principle of the device in accordance with the invention (direction of view transverse to a general direction of conveyance F);

FIGS. 2 to 7 show some schematically illustrated, exemplary embodiments of split-up points of the device according to the invention, in which the direction of view is parallel to a general direction of conveyance F;

DETAILED DESCRIPTION OF THE PREFERRED EMBODIMENTS

Figure 3:
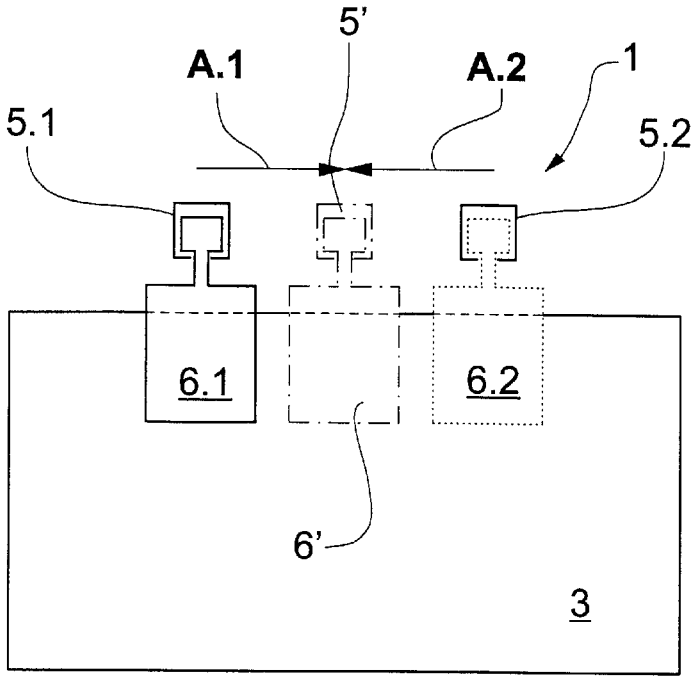

FIG. 1 illustrates the operating principles of the method and device according to the present invention. Depicted is an exemplary split-up point 1 with the direction of view transverse to the conveying direction F. At the split-up point 1, a stream 2 of supplied objects 3, for example, an imbricated stream of printed product, is split-up into three conveying away paths 4.1, 4.2 or 4.3. The three conveying away paths 4.1 to 4.3 are defined by rail tracks 5.1 to 5.3, along which holding means 6.1, 6.2 and 6.3 are movable at variable distances from one another. The objects are conveyed away by the holding means 6.1 to 6.3, for example, in a suspended position.

The rail tracks 5.1 to 5.3 extend through the split-up point, for example, in the paper plane of FIG. 1, while the supplied objects 3 are positioned behind or underneath this plane and approach this plane coming from the left, until they can be picked up by the holding means 6.1 to 6.3 extending from the plane of the rail tracks 5.1 to 5.3 toward edge zones of the objects positioned for being picked up by the holding means.

As already mentioned further above, depending on the design of the holding means or grippers 6.1 to 6.3, the rail tracks 5.1 to 5.3 converge toward the split-up point 1 or else they are parallel in this zone (as illustrated in FIG. 1). They pass through the split-up point 1 adjacent and parallel to one another and diverge after the split-up point 1. The depicted rail tracks 5.1 to 5.3 advantageously are parts of three closed-in-themselves or closed-loop rail tracks, of which each closed-loop rail track belongs to one of the three conveying away systems.

Upstream of the split-up point 1, the holding means 6.1, 6.2 and 6.3 are buffered on each of the rail tracks 5.1, 5.2 and 5.3. They are released from buffering in accordance with the splitting-up sequence and are driven through the split-up point 1 in a serial stream of holding means, within which consecutive holding means 6.1, 6.2 or 6.3 can belong to different conveying away streams and are therefore conveyed along different rail tracks 5.1, 5.2 or 5.3. Conveyance of holding means 6.1, 6.2 or 6.3 through the split-up point 1 leads these toward the supplied objects 3 such that objects 3 are picked up by activating holding means and are conveyed away in a held manner.

From FIG. 1 it is also evident that, when using holding means 6.1, 6.2 and 6.3 of the same design for all conveying away systems, the objects 3 are picked up in different holding zones by holding means of different conveying away systems. According to FIG. 1, the holding means 6.2 are movable along the middle rail track 5.2 and grip an object in the middle of its edge. Holding means 6.1 and 6.3 of the other two rail tracks 5.1 and 5.3 grip the objects in a holding zone off this middle (i.e., toward a lateral edge of the object), as illustrated.

This is even more apparent from FIG. 2, which shows the arrangement in accordance with FIG. 1 in a schematic 3D-view with the direction of view essentially parallel to the conveying paths 4.1 to 4.3 running through the split-up point 1 (indicated as dot-and-dash lines).

Shown right at the front are the three rail tracks 5.1 to 5.3 in cross-section transverse to the direction of conveyance F, with corresponding holding means 6.1 (unbroken line), 6.2 (dot-and-dash line) and 6.3 (dotted line). For showing the different holding zones on an object 3 to be picked up or already picked up, the holding means 6.1, 6.2 and 6.3 are illustrated in front in interaction with a single object 3. Such simultaneous interaction is, of course, not possible in the serial stream of holding means being conveyed through the split-up point.

Shown in the direction of conveyance further downstream are a further three objects, the first one of which is conveyed held by a holding means 6.2 movable along the rail track 5.2, the second one by a holding means 5.3 movable along the rail track 5.3 and the third one by a holding means 6.1 movable along the rail track 5.1. An arrangement of holding means and objects of this kind is possible in reality. It represents the serial stream of holding means, in which each holding means 6.1, 6.2 or 6.3, conveyed one behind the other, is movable along a different rail track 5.1, 5.2 or 5.3.

Various measures can be implemented to ensure that the objects being held by holding means movable along different rail tracks are not picked up and held in different holding zones as depicted in the FIGS. 1 and 2. Examples of such measures are illustrated by FIGS. 3 to 7. In these Figures, split-up points 1 with a plurality of rail tracks and holding means are depicted with a viewing direction parallel to the conveying direction. In these Figures, identical parts are designated with same reference numbers as in the FIGS. 1 and 2.

FIG. 3 depicts a split-up point 1 with two parallel rail tracks 5.1 and 5.2, along which holding means 6.1 (unbroken line) and 6.2 (dotted line) are movable. In order for positioned objects 3 to be picked up in a predetermined, for example central, holding zone, both by the holding means 6.1 as well as by the holding means 6.2, the one rail track (5.1 or 5.2) carrying the holding means designated for the picking-up, is moved transverse to the conveying direction into a position 5' (dot-and-dash line) (arrows A.1 and A.2). From this rail track position a holding means 6' movable along the displaced rail track can pick up the object 3 in the predetermined holding zone.

Figure 4:
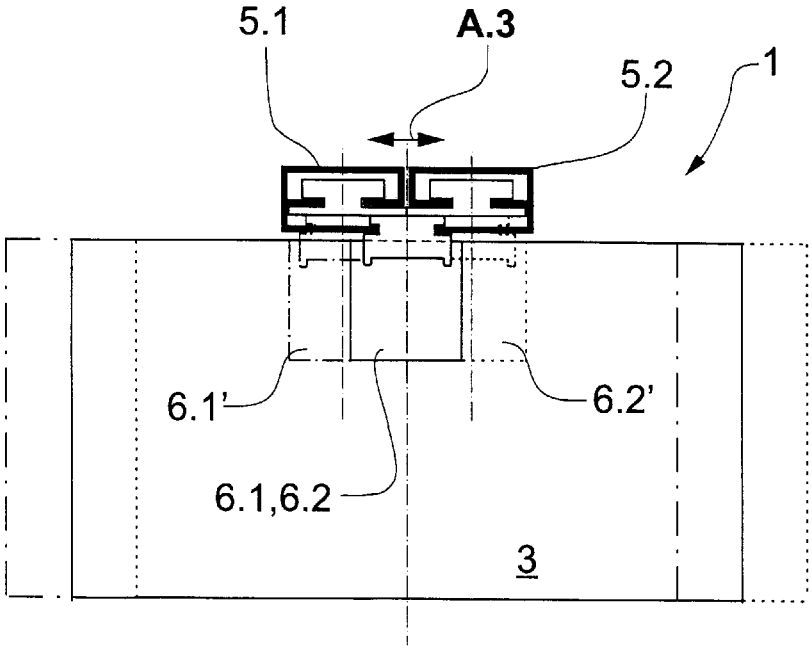

FIG. 4 illustrates a split-up point 1 with a pair of rail tracks 5.1 and 5.2 running parallel and adjacent to one another and holding means 6.1 and 6.2 being couplable to two magnetic slip-drives, as described in the publication WO-99/33731 (FIGS. 9*a* to 9*c*). At the split-up point, the two rail tracks run together and the grippers are brought to an identical middle position (represented as an unbroken line) (arrow A.3), independent to which rail track they are belonging to, and they pick-up the objects 3 in the middle. After the split-up point, the rail tracks diverge (positions 6.1' and 6.2' of the holding means).

Figure 5:
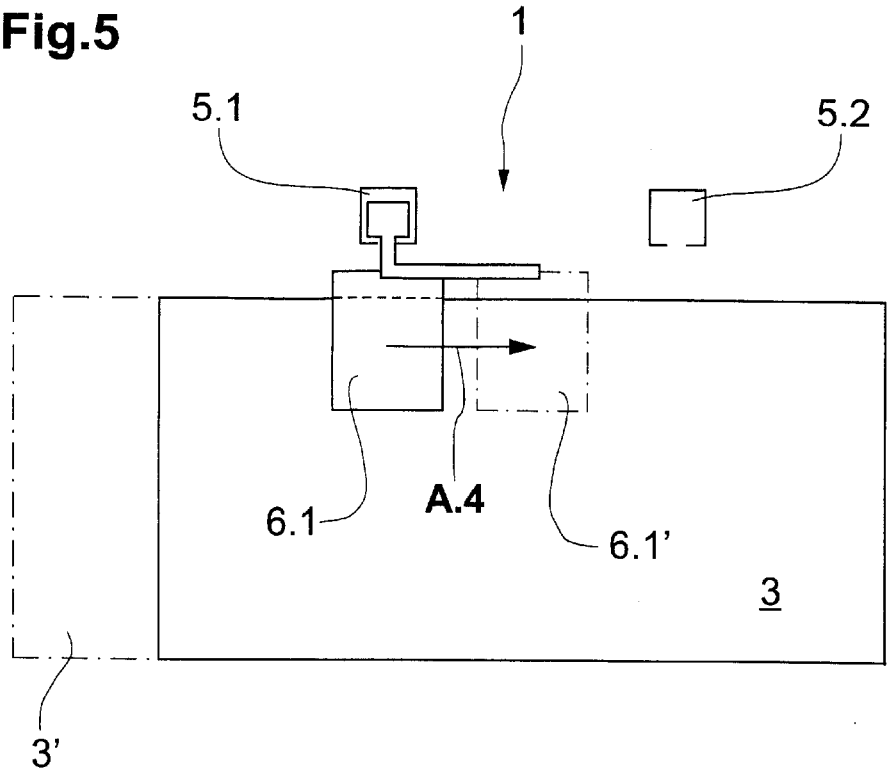

FIG. 5 depicts a split-up point 1, once again with two rail tracks 5.1 and 5.2 running parallel to one another. Holding means (only 6.1 shown) movable along the rail tracks are displaceable relative to the rail track transverse to the conveying direction (arrow A.4 to position 6.1', which is represented with a dot-and-dash line), such that the holding means of both rail tracks, when displaced, is able to pick up a positioned object 3 in the same, predetermined holding zone (for example, in the middle). After picking up, the holding means can be moved back again (position 6.1) for conveying the object (3' represented with a dot-and-dash line) away.

Figure 6:
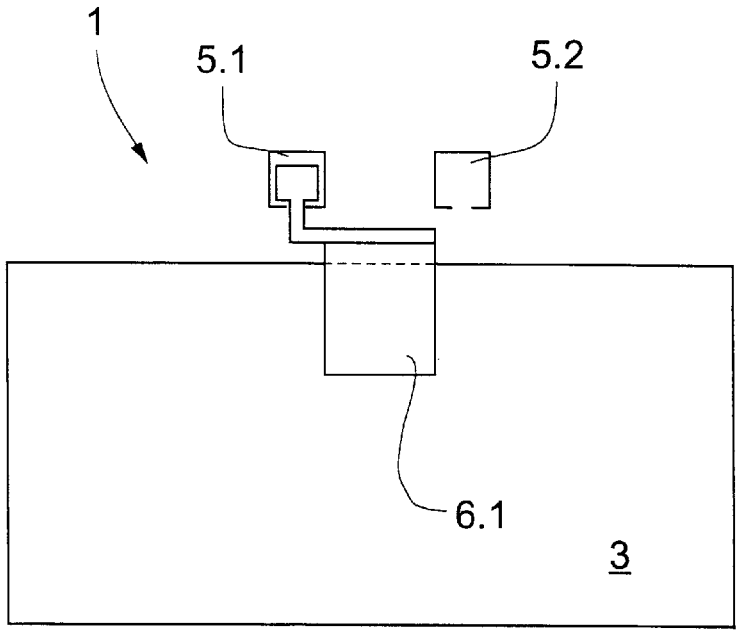

FIG. 6 depicts a split-up point 1, once again with two rail tracks 5.1 and 5.2 running parallel to one another. The holding means (only one holding means 6.1 is shown) are designed such that they are conveyed on a conveying path, which is offset relative to the rail track. Using holding means on tracks 5.1 and 5.2 that are offset in opposite directions, it becomes possible to transport the holding means of both rail tracks on the same conveying path and, independent of the rail track they are to be conveyed away on, to pick up the objects 3 in the same holding zone without the necessity of an active displacement of the object or any other parts.

Figure 7:
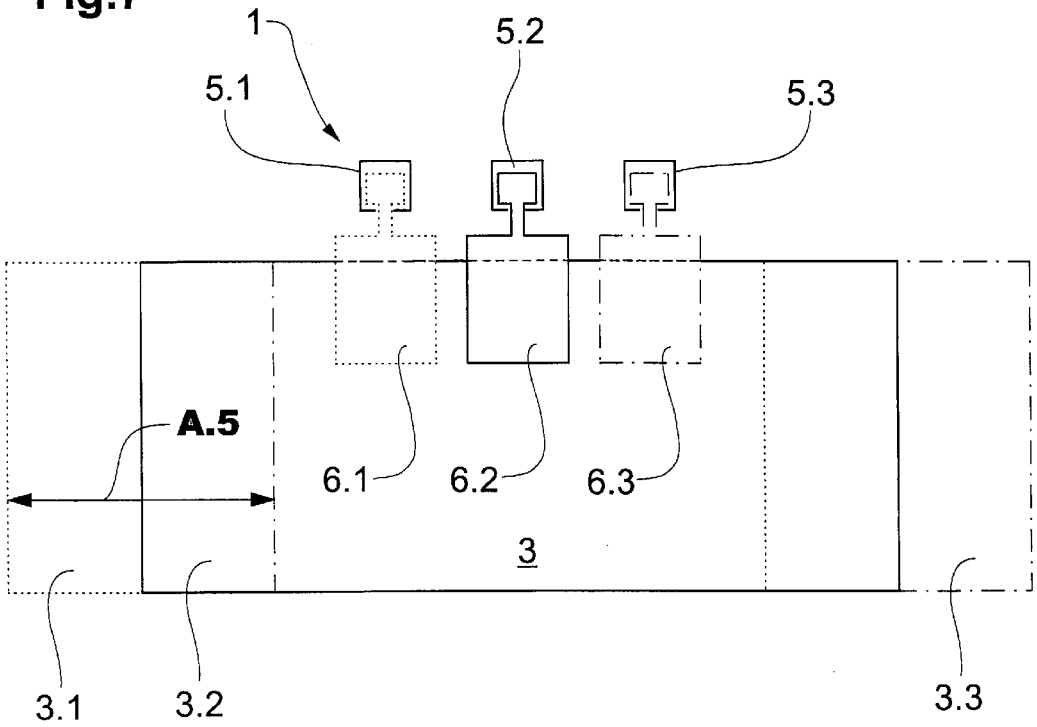

FIG. 7 illustrates a split-up point with three rail tracks 5.1, 5.2 and 5.3 running parallel to one another and with corresponding holding means 6.1 (dotted line), 6.2 (unbroken line) and 6.3 (dot-and-dash line). For a central picking up of objects 3 positioned at the split-up point, the objects are displaced transverse to the conveying direction into a corresponding pick-up position 3.1 (dotted line), 3.2 (unbroken line) or 3.3 (dot-and-dash line) (arrows A.5). For displacing the objects 3, either only individual objects, the whole conveying means, or parts thereof, are displaced transverse to the conveying direction.

Figure 8:
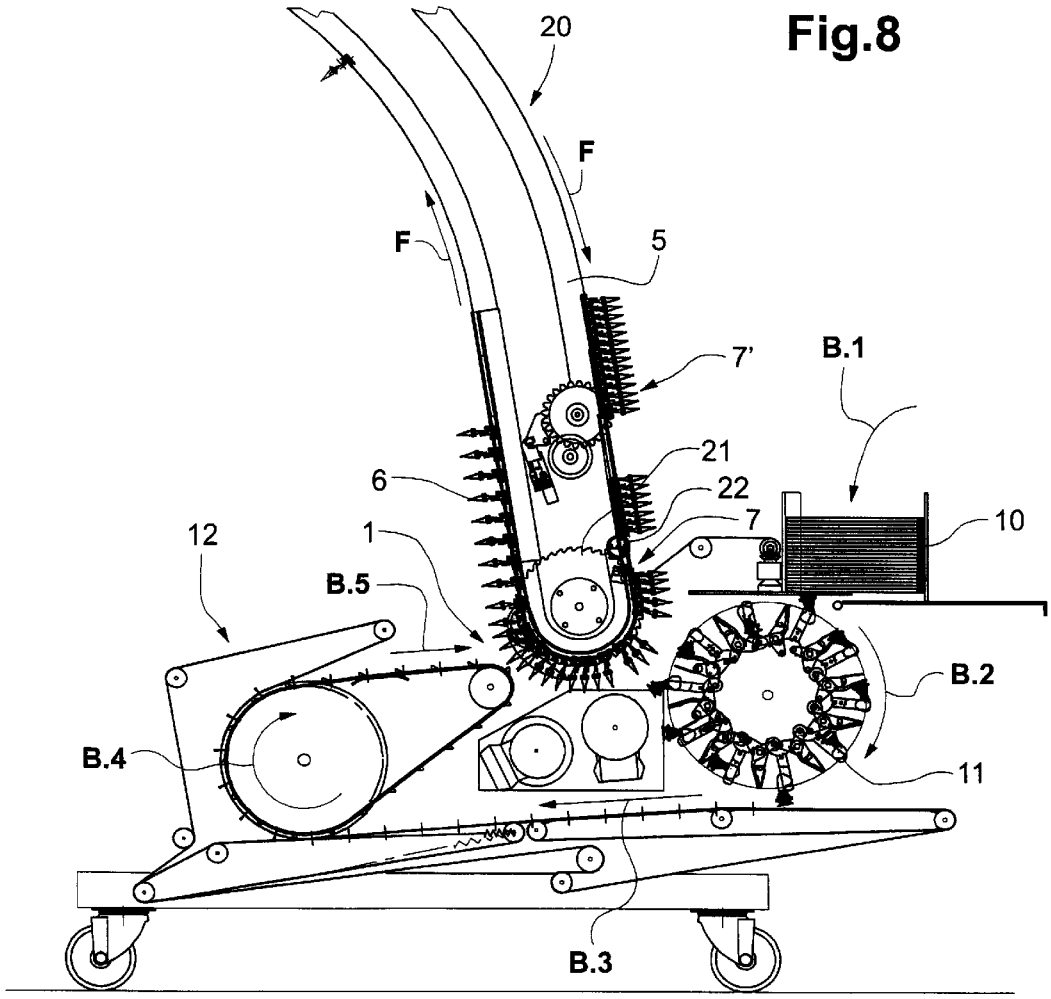
FIG. 8 shows a detailed representation of an exemplary embodiment of the device in accordance with the invention.

FIG. 8 depicts an exemplary embodiment of the device in accordance with the invention for splitting up a stream of printed products into a plurality of conveying away streams, wherein only one of the conveying away systems is visible.

The supply means for conveying the objects in a serial stream to the split-up point 1 and for positioning the objects in the split-up point, comprises for the illustrated device in per se known manner, a stacking device 10, a decollating wheel 11, and a conveying means 12 for conveying an imbricated stream or sections of an imbricated stream. The stacking device 10 receives stacked printed products, which, for example, are filled into the stacking device 10 by hand (arrow B.1). With the help of the decollating wheel 11, the printed products are decollated from the stacking device 10 and are deposited on the conveying means 12 in an imbricated formation (arrow B.2). With the help of the conveying means, the imbricated formation is conveyed to the split-up point 1 (arrows B.3, B.4 and B.5).

Instead of the supply system as shown in FIG. 8, which functions like a sheet feeder feeding from a stack, the printed products can also be supplied from other storing formations. For example, the printed products can be supplied from a coil by means of an uncoiling station, wherein from the coil an imbricated stream of printed products is uncoiled and conveyed to the split-up point 1.

The conveying away systems 20, of which only one is visible and of which the others are located behind this one, comprise a closed-loop rail track 5, along which holding means 6 in the form of grippers are movable in a conveying direction F with variable distances between one another. The holding means 6 are conveyed through the split-up point 1 by a drive wheel 21. All conveying away systems 20 comprise an identical drive wheel 21 and all drive wheels are arranged coaxially with shafts transverse to the conveying direction F and as closely adjacent to one another as possible. Upstream of each drive wheel 21 there is a buffer 7 for the holding means (for empty holding means). The buffer includes a holding means stop 22 behind which the holding means, driven either by the force of gravity or by a slip-drive, pile up. This holding means stop 22 is appropriately controlled to provide or release one holding means 6 at a time to the drive wheel 21. For the purpose of relieving the holding means stop 22, a pre-buffer 7' may be located upstream of the holding means buffer 7.

Downstream of the split-up point 1, i.e., after the picking up of a printed product, the holding means 6 are conveyed away, for example, by the same slip-drive as used for the buffering upstream of the drive wheel 21.

Obviously, it is possible to use in a device for splitting-up a stream of piece goods, more than one supply means, the plural supply means being selectively connected to the split-up point and, therewith, to the plurality of conveying away systems by means of a corresponding shunt.

Figure 9:
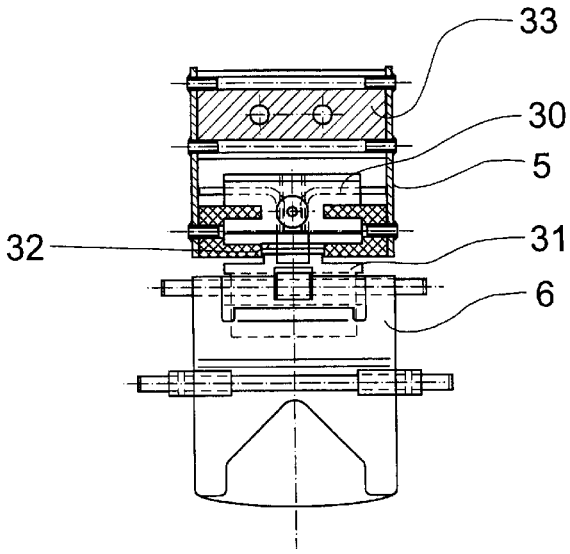
FIG. 9 shows a rail track with drive and holding means for a conveying away system of the device according to FIG. 8 seen in cross-section transverse to the rails; and, FIGS. 10 and 11 show an exemplary application of the device in accordance with FIG. 8 in side view (FIG. 10) and from a bird's eye view (FIG. 11).

FIG. 9 depicts a rail track 5 with a magnetic slip-drive in cross-section and a holding means 6 movable along the rail track 5. The illustrated rail track 5 and the holding means 6 are applicable to the conveying away system of the device discussed hereinbefore and illustrated in FIG. 8. The holding means 6 has a sliding block 31 which, at least in the vicinity of a coupling surface 32, partially consists of a ferro-magnetic material. The sliding block 31 comprises two lateral grooves that receive the rail track 5. The slip-drive comprises drive elements 30 consisting of a ferro-magnetic material and being driven along the stretch of rails 5 by a suitable drive. The drive elements 30 also have two lateral grooves that receive the rail track 5. In zones of the rail track 5 in which the holding means 6 are to be actively conveyed, permanent magnets 33 and magnetic conductance guiding organs are located in the vicinity of the rail track. These, together with the ferro-magnetic parts of the drive elements 30 and the ferro-magnetic parts of the sliding blocks 31 of the holding means, form a magnetic circle, through which the sliding block 31 is pulled toward the drive elements 30 by magnetic forces, adheres to the drive elements, and is moved with the drive elements in the conveying direction.

When the holding means 6 are stopped by a suitable stop, the moving drive elements 30 slide relative to the sliding blocks 31 of the stopped holding means 6, which is suitable for the buffering of holding means 6 on substantially level zones of the rail track 5. On zones of the rail track that slope downwardly, the force of gravity can be exploited for the buffering of the holding means 6.

Conveyor systems as illustrated in FIG. 8 as conveying away systems and in FIG. 9 as a detail, are described in the publications WO-99/33731. Further conveying devices suitable as conveying away system in a device in accordance with the invention are described in the publication EP-633212. In these devices, the holding means are connected together with spring-like links to form a chain with variable distances between holding means.

Figure 10:
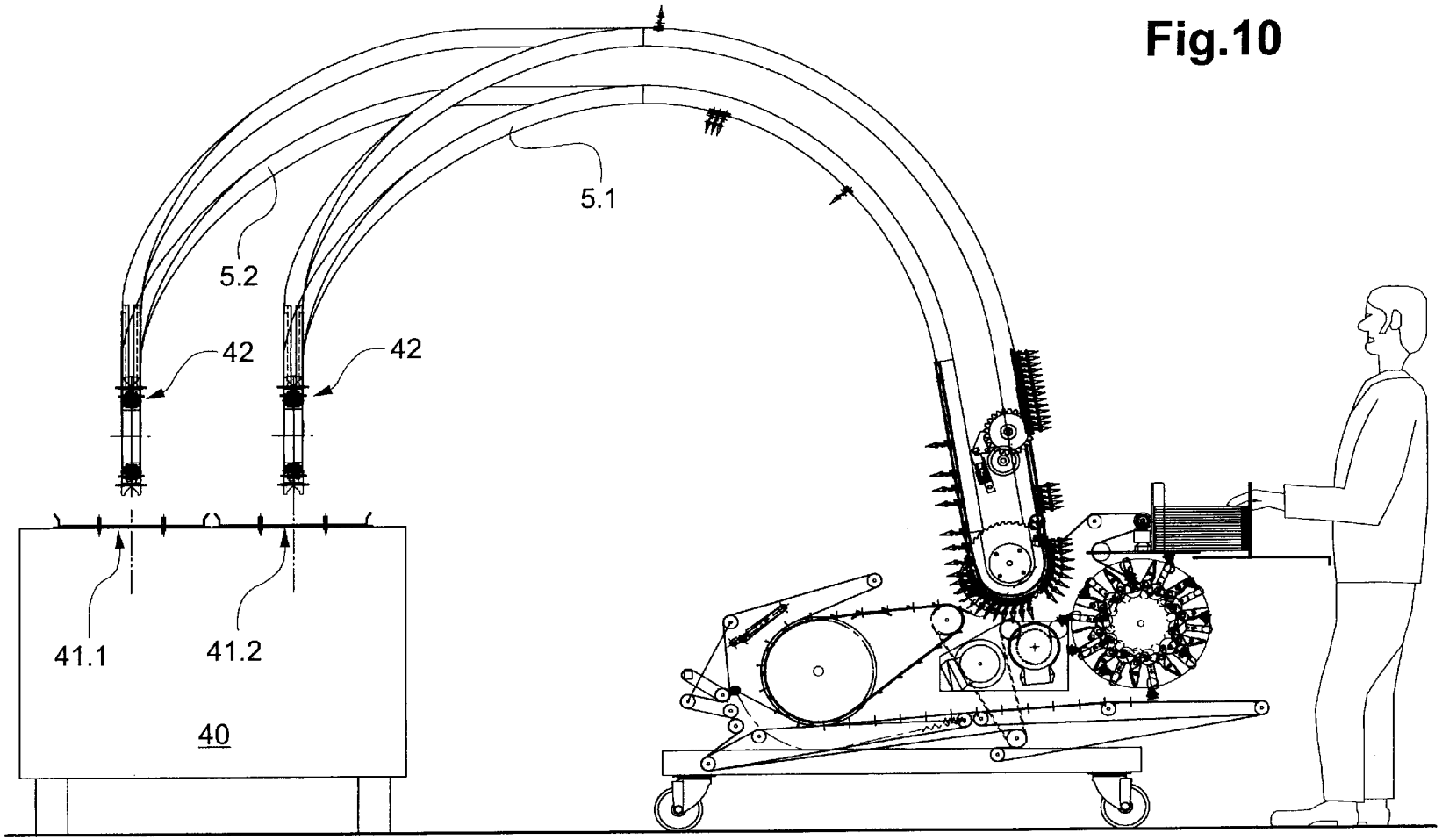
Figure 11:
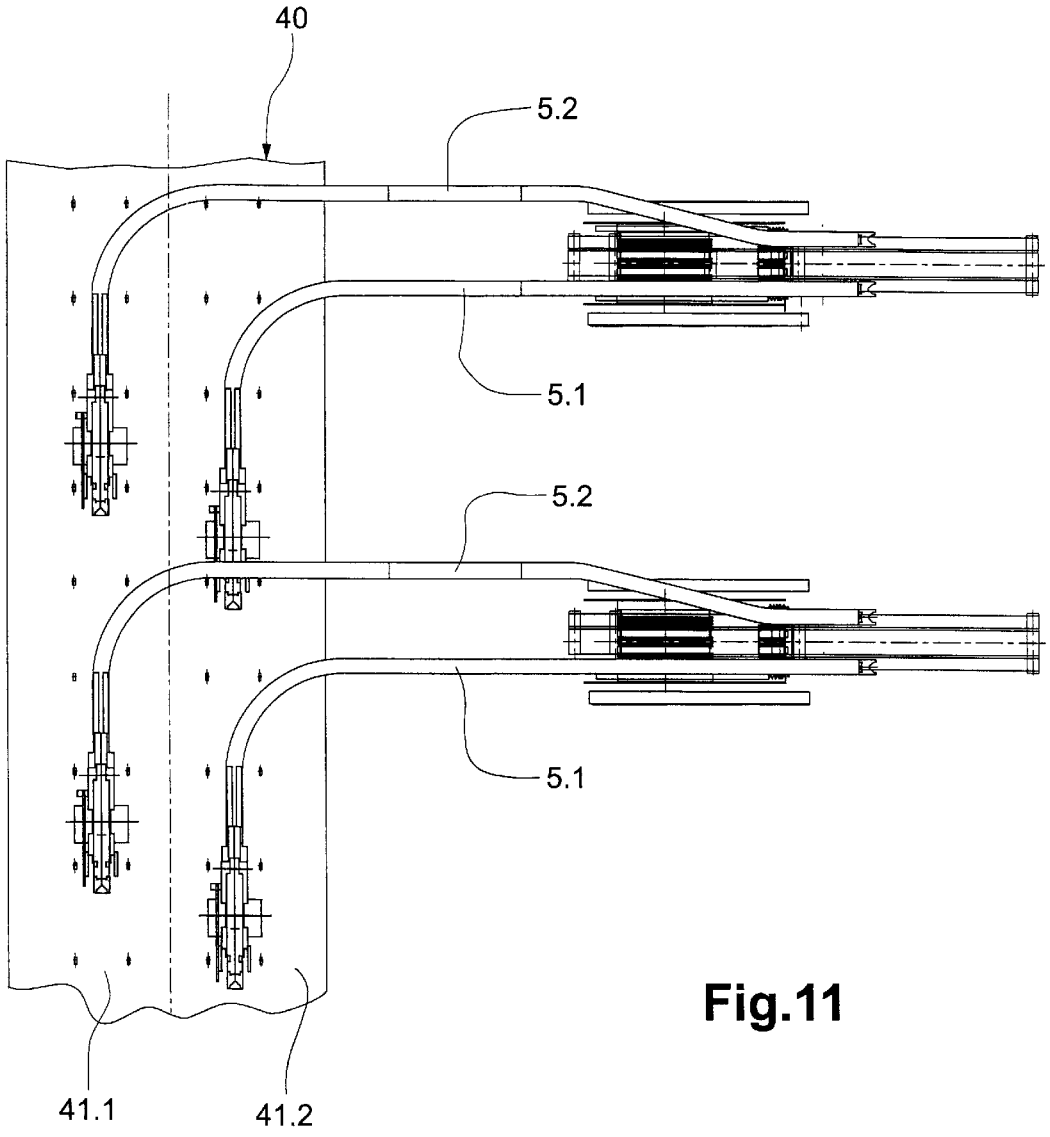

FIGS. 10 and 11 illustrate an exemplary application of a device according to the invention, as is depicted, for example, in FIG. 8 (FIG. 10: side view; FIG. 11: bird's eye view). The device comprises at least two conveying away devices, each with a closed-loop rail track 5.1 and 5.2. The device serves to feed part products to a collating device 40, in which on two or more collating stretches 41.1 and 41.2, which run essentially parallel to one another, similar or identical products are produced by collation of part products. At feed points in which identical part products are fed to both collating stretches, a device as depicted in FIGS. 10 and 11 is advantageously utilized. The conveying away systems of the device advantageously also has a holding means buffer 42 on the delivery side immediately ahead of the point at which the part products are delivered to the collating stretch. In this application of the present invention, the device in accordance with the invention is essentially used for alternatingly filling the two holding means buffers 42 of the two conveying away systems.

For a device as illustrated in FIGS. 10 and 11, it is in no way a prerequisite that the two collating devices are operated with the same performance capacity or that both collating devices are active. The performance capacities of the collating devices are completely de-coupled from one another. The supply capacity has to be adapted to the overall consumption by the collating device(s) averaged over time. Due to the buffering of the products to be fed in, however, the supply capacity is, to a great extent, de-coupled from the performance capacities of the collating devices.

In a similar manner as depicted in FIGS. 10 and 11, the device in accordance with the invention can also be utilized for supplying products to other processing stations that are, in essence, operated in parallel.

What is claimed is:

1. A method for splitting-up a serial stream (2) of objects according to a predetermined splitting-up sequence, said objects to be conveyed away along a plurality of conveying away paths, the method comprising the steps of:

serially supplying objects (3) to a split-up point (1) and positioning each object in predetermined fashion at the split-up point (1), providing for each one of the plurality of conveying away paths a rail track and a plurality of holding means assigned fixedly to the rail track and movable along the rail track with variable distances between one another, each rail track running through the split-up point and comprising means for buffering the holding means upstream of the split-up point, at the split-up point, taking over each positioned object by one of the buffered holding means (6), and serially conveying away the objects (3) from the split-up point, each object being held by a holding means (6), wherein a sequence of the holding means (6.1, 6.2, 6.3) assigned to different conveying away paths in the serial holding means stream conveyed through the splitting-up point corresponds to the splitting-up sequence.

2. The method in accordance with claim 1 wherein the splitting-up sequence is predetermined from outside or is adapted to conditions upstream or downstream of the split-up point (1) that are recorded by sensor means.

3. The method in accordance with claim 1, wherein, for establishing the serial stream of holding means, the holding means (6.1, 6.2, 6.3) assigned to different conveying away paths are released from a plurality of holding means buffers (7.1, 7.2, 7.3), which are also assigned to the different conveying away paths.

4. The method in accordance with claim 1, wherein the holding means (6.1, 6.2, 6.3) assigned to the different conveying away paths are conveyed through the split-up point (1) on different conveying paths, said different conveying paths being parallel to one another.

5. The method according to claim 4, wherein the objects (3) positioned in the split-up point (1) for being taken over by the holding means (6.1, 6.2, 6.3) are taken over in different holding zones by holding means (6.1, 6.2, 6.3) assigned to different conveying away paths.

6. The method in accordance with claim 4, wherein, for taking over the objects (3) positioned in the split-up point (1) in a same holding zone by holding means (6.1, 6.2, 6.3) assigned to different conveying away paths, the conveying paths are displaced.

7. The method in accordance with claim 4, wherein, for taking over the objects (3) positioned at the split-up point (1)

in a same holding zone by the holding means (6.1, 6.2, 6.3) assigned to different conveying away paths, the holding means are displaced transverse to the conveying paths.

8. The method according to claim 4, wherein the objects (3) are positioned differently in the split-up point (1) to such an extent that they are picked up in a same holding zone by holding means (6.1, 6.2, 6.3) assigned to different conveying away paths.

9. A method for splitting-up a serial stream (2) of objects according to a predetermined splitting-up sequence, said objects to be conveyed away along a plurality of conveying away paths, the method comprising the steps of:

serially supplying objects (3) to a split-up point (1) and positioning each object in predetermined fashion at the split-up point (1), providing holding means (6.1, 6.2, 6.3), said holding means being conveyed in a serial holding means stream through the split-up point (1), each holding means (6.1, 6.2, 6.3) being assigned fixedly to one of the plurality of conveying away paths, at the split-up point, taking over each positioned object by one of the holding means (6), and serially conveying away the objects (3) from the split-up point, each object being held by a holding means (6), wherein a sequence of the holding means (6.1, 6.2, 6.3) assigned to different conveying away paths in the serial holding means stream conveyed through the splitting-up point corresponds to the splitting-up sequence, wherein the holding means (6.1, 6.2, 6.3) assigned to the different conveying away paths are conveyed through the split-up point (1) on different conveying paths, said different conveying paths being parallel to one another, and wherein, for taking over the objects (3) positioned in the split-up point (1) in the same holding zone by the holding means (6.1, 6.2, 6.3) assigned to different conveying away paths, the holding means (6.1., 6.2, 6.3) assigned to different conveying away paths differ in design.

10. A device for splitting-up a serial stream (2) of objects (3) according to a predetermined splitting-up sequence, wherein the objects after being split-up, are conveyed away along a plurality of conveying away paths, the device comprising:

a supply device (10, 11, 12) for serially supplying the objects and for positioning the objects (3) at a split-up point (1), assigned to each of said plurality of conveying away paths, a conveying away system for conveying away the objects (3) from the split-up point (1) in a held manner, each of the conveying away systems comprising a rail track (5.1, 5.2, 5.3) and a plurality of holding means (6.1, 6.2, 6.3), said holding means being movable in a conveying direction (F) along the rail track (5.1, 5.2, 5.3) with variable distances between one another, wherein each of the rail tracks (5.1, 5.2, 5.3) run through the split-up point (1) in a direction of conveyance (F) and parallel to one another and diverge downstream of the split-up point (1), wherein each of the conveying away systems further comprises means for buffering the holding means (6.1, 6.2, 6.3) upstream of the split-up point (1), means for releasing the holding means (6.1, 6.2, 6.3) from the buffering means (7.1, 7.2, 7.3) in a controlled manner, and means (21) for conveying the holding means (6.1, 6.2, 6.3) through the split-up point (1) in a controlled manner, and wherein the device further comprises means for coordinating release of the holding means from the buffering means (7.1, 7.2, 7.3) in accordance with the splitting-up sequence.

11. The device in accordance with claim 10, wherein the holding means (6.1, 6.2, 6.3) are movable along the rail tracks (5.1, 5.2, 5.3) independently of one another or connected together with flexible links in such a manner, that the distances between the holding means (6.1, 6.2, 6.3) are variable.

12. The device according to claim 10, wherein each conveying away system includes means for controlled conveyance of the holding means (6.1, 6.2, 6.3) through the split-up point (1), said controlled conveyance means including a drive wheel (21).

13. The device in accordance with claim 12, wherein said drive wheels (21) of the conveying away systems are arranged coaxially.

14. The device in accordance with claim 10, wherein the rail tracks (5.1, 5.2, 5.3) of the conveying away systems running through the split-up point (1) are displaceable transverse to the conveying direction (F) such that the holding means (6.1, 6.2, 6.3) of each conveying away system at the split-up point (1) is capable of being brought into a same predetermined position relative to the objects (3) positioned at the split-up point (1).

15. The device according to claim 10, wherein, at least at the split-up point (1), the holding means (6.1, 6.2, 6.3) are displaceable transverse to the conveying direction (F) relative to the rail track (5.1, 5.2, 5.3) along which they are movable such that the holding means (6.1, 6.2, 6.3) of each conveying away system is capable of being brought into a same predetermined position relative to the objects (3) positioned at the split-up point (1).

16. The device in accordance with claim 10, wherein the holding means (6.1, 6.2, 6.3) of the different conveying away systems are designed such that the holding means (6.1, 6.2, 6.3) of each conveying away system is capable of being brought into a same predetermined position relative to the objects (3) positioned at the split-up point (1).

17. The device according to claim 10, wherein at least portions of the supply means (10, 11, 12) for serially supplying and positioning the objects (3) in the split-up point (1) are displaceable transverse to the direction of conveyance (F) such that the holding means (6.1, 6.2, 6.3) of each conveying away system at the split-up point (1) are capable of being brought into a same predetermined position relative to the objects (3) positioned at the split-up point (1).

18. The device according to claim 10, wherein the supply device (10, 11, 12) for serially supplying and positioning the objects (3) at the split-up point (1) comprises a stacking device (10), a decollating wheel (11), and a conveying means (12) for conveying an imbricated stream of objects.

19. The device in accordance with claim 10, wherein the supply device (10, 11, 12) for serially supplying and positioning the objects (3) in the split-up point (1) comprises an uncoiling station for uncoiling a coil of printed products.

20. The device according to claim 10, further comprising a plurality of supply devices (10, 11, 12) that are selectively connectable to the split-up point (1).

21. Use of a device in accordance with claim 10 for supplying printed products to a plurality of processing stations operating in parallel.

22. Use of a device according to claim 10 for supplying printed products to a plurality of devices (41.1, 41.2) for collating printed products, said plurality of devices operating in parallel.

* * * * *